United States Patent [19]

Rarey et al.

[11] 4,004,508

[45] Jan. 25, 1977

[54] MAGNETIC STIRRING APPARATUS FOR DEVELOPER MIXTURES

[75] Inventors: Kenneth W. Rarey, South Holland; John B. Kennedy, Jr., Oak Forest, both of Ill.

[73] Assignee: Continental Can Company, Inc., New York, N.Y.

[22] Filed: Jan. 25, 1971

[21] Appl. No.: 109,261

[52] U.S. Cl. ..... 101/114; 118/644; 427/18; 101/DIG. 13

[51] Int. Cl.[2] ..... B41F 15/00

[58] Field of Search ..... 101/DIG. 13, 114; 118/637; 117/DIG. 6; 427/18, 47, 48, 127–128

[56] References Cited

UNITED STATES PATENTS

| | | | |
|---|---|---|---|
| 3,176,652 | 4/1965 | Mott et al. | 118/637 |
| 3,202,092 | 8/1965 | Childress | 101/DIG. 13 |
| 3,306,193 | 2/1967 | Rarey et al. | 101/DIG. 13 |
| 3,557,751 | 1/1971 | Kushima | 118/637 |
| 3,592,166 | 7/1971 | Wu | 118/637 |
| 3,610,205 | 10/1971 | Rarey et al. | 118/637 |

FOREIGN PATENTS OR APPLICATIONS

| | | | |
|---|---|---|---|
| 9,466 | 5/1965 | Japan | 427/18 |

*Primary Examiner*—E. H. Eickhoit
*Attorney, Agent, or Firm*—Diller, Brown, Ramik & Wight

[57] ABSTRACT

Apparatus for stirring developer mixtures including ferromagnetic particles. Developer is located within a magnetic field created by either permanent or electromagnets. The field intensity is variably controlled and the time-rate for decreasing the field intensity is controlled.

11 Claims, 6 Drawing Figures

INVENTORS
KENNETH W. RAREY
& JOHN B. KENNEDY, Jr.

By
Dixon, Brown, Ramik & Holt
ATTORNEYS

INVENTORS
KENNETH W. RAREY
& JOHN B. KENNEDY, Jr.

By
Dickerson, Brown, Ramik & Holt
ATTORNEYS

MAGNETIC COIL CURRENT WAVEFORM $75 \leq \tau_1 \leq 225$ MILLISECONDS
$50 \leq \tau_2 \leq 250$ MILLISECONDS
$0 < A \leq 3.8$ AMPERES INVENTORS
KENNETH W. RAREY
& JOHN B. KENNEDY, Jr.

By Dixon Brown, Ramik + Holt
ATTORNEYS

MAGNETIC STIRRING APPARATUS FOR DEVELOPER MIXTURES

BACKGROUND OF THE INVENTION

1. Field of the Invention

The invention relates to the use of developer mixtures including carrier particles and toner particles, and more particularly relates to the use of such developer in electrostatic printing or copying devices.

2. Description of the Prior Art

Developer mixtures which are comprised of ferromagnetic carrier particles and electrically non-conductive toner particles are known. Such developer can be used, for example, in electrostatic stencil screen printing apparatus as exemplified by U.S. Pat. No. 3,306,193, and is useful in xerographic apparatus such as exemplified by U.S. Pat. No. 3,094,049. In the printing or copying operations performed by the prior art devices, the developer of toner and carrier is presented to a work station wherein toner, which is the electrostatic analogue of ink, is expended by the printing or copying operation. The carrier is a granular component of the developer and it is not expended during the printing or copying operation. Either process of the prior art requires that the developer be a homogeneous mixture or carrier and toner. Since toner is expended during the printing or copying processes, an initial homogeneous mixture of developer is converted to a heterogeneous mixture which is no longer suitable for quality performance of the printing or coating operations.

SUMMARY OF THE INVENTION

While the present invention is not limited to electrostatic stencil screen printing, it is particularly adaptable for use with such printing and will be described with reference thereto. Electrostatic stencil screen printing machines are old as shown by U.S. Pat. No. 3,306,193 and by co-pending U.S. application No. 768,377 filed on Oct. 17, 1968 and now U.S. Pat. No. 3,610,205. Printing and stencil-cleaning operations performed by these machines convert a homogeneous developer into a heterogeneous one and usually necessitate complete change of developer in the printing zone between successive printing operations. The developer thus removed has the expended toner replaced and mixed until it is homogeneous and can then be returned to the printing zone. The belt which conveys the developer into the printing zone may travel at speeds up to at least 300 feet per minute. The printing zone may have a length in the range of ½ to several feet, in the direction of belt travel. For a belt speed of 300 feet per minute and a printing zone length of 5 feet, one second would be required to change the developer in the printing zone. Printing and stencil-cleaning operations each requires approximately 1/10th of a second. Thus, a printing operation could occur every 1 and 2/10th seconds. This means the printing rate could not exceed 50 impressions per minute. Fortunately, not all patterns to be printed are five feet in length, and smaller patterns do permit higher printing rates. Unfortunately, some patterns are five feet in length, and for some of these a rate of 50 impressions per minute is inadequate for commercial practice. Thus, it is apparent that the described process is not entirely suitable for printing large patterns at a high rate of speed. The path out of this dilemma resides in the fact that the developer within the printing zone contains sufficient toner at any given time to make several prints without adversely influencing the quality; it is the heterogeneity of the developer that makes it inadequate, not the toner depletion. One solution to the problem is to provide means for mixing the developer in the printing zone to restore its homogeneity. As a result, more than one print can be made from developer in the printing zone and the printing rate is increased, even for large patterns, sufficiently high to be commercially useful.

The significance of the relative content of toner and carrier in the developer is of considerable interest. The printing process appears to be quite independent of the exact relative content of the developer components as long as the mixture contains from 2 to 4% toner, by weight. Outside of this range the process is quite responsive to relative toner content. With too little toner in the developer, too much time is required for toner to be delivered to the stencil simply because of its scarcity. With too much toner in the developer, the electrical conductivity of the mixture is adversely affected. The toner insulates the carrier particles sufficiently from the various electrodes and from each other so that the particles do not charge properly to provide the vigorous oscillation required for printing. Now, for example, if the developer has 3 % toner by weight, sufficient toner would be present in the printing zone at any one time to print a solid area the size of the printing zone about 50 times. About 15 of these prints could be made before the toner content would be reduced to approximately 2%. Thus, about 15 prints can be made without altering the printing conditions or quality. This assumes, of course, that developer is thoroughly mixed between printing operations, so that it is homogeneous.

If the developer must be removed from the printing zone in order to be mixed, the printing rate is low as indicated above. However, if the developer can be mixed in the printing zone, and in appreciably less time than required to change the mixture, then a higher printing rate can be obtained. Heretofore, mixing in the printing zone was not an easy task. After printing and stencil-cleaning operations, the top layer or two of developer has a deficiency of toner. The next layer is enriched in toner. The remainder of the developer is still homogeneous; it is undisturbed by the printing and stencil-cleaning operations. The top layer or two of carrier particles are the ones that oscillate during printing and stencil-cleaning; during both operations the layers tend to surrender the toner and end up toner-deficient. The toner-enriched layer occurs because of toner removed from the stencil by the stencil-cleaning operation. The toner accumulates on the uppermost layer of developer that did not participate in the oscillations associated with printing and stencil-cleaning. Mixing in the printing zone minimally requires that the toner-deficient and toner-enriched layers of developer be turned under and be replaced by the undisturbed mixture found underneath. Complete homogeneity throughout the depth of the developer is not required. However, exchanging upper and lower layers accomplishes a fair amount of stirring. In the described printing machines, the developer and stencil screen are only separated by about ¼ of an inch, so there is very little space in which to cause mixing. Further, the developer must be of very uniform depth throughout the printing zone after mixing is complete. In addition, there can be no object located between the base electrode and stencil during printing and stencil-cleaning because this will cause arcing between the base electrode and stencil screen. Therefore, if any stirring or doctoring device is inserted in the printing zone to accomplish mixing or levelling, such device must be removed during the printing and stencil-cleaning operations.

In summary, the developer must be mixed sufficiently to provide homogeneous upper layers with a toner content of from 2 to 4% by weight. This mixing must be accomplished over a large area involving perhaps ten or more square feet of printing zone. The height of the printing zone in which mixing must occur is approximately ¼th of an inch. The upper surface of the developer must be quite level before quality printing can occur. Also, no stirring or levelling device can be located between the base electrode and stencil screen during the time when printing and stencil-cleaning are occurring. In addition, in order to be commercially practical, all stirring and levelling must be accomplished in less than perhaps 4/10ths of a second.

An object of the present invention is to provide a solution for the difficult task of mixing developer to provide a homogeneous mixture in a very short length of time.

Another object of the invention is to provide magnetic stirring apparatus for homogenizing a developer which is comprised of magnetic particles and non-magnetic particles.

A further object of the invention is to provide apparatus for controlling the time-decay of a magnetic field for providing a smooth surface on a layer of developer located within a printing zone.

DESCRIPTION OF THE PREFERRED EMBODIMENTS

Figure 1:
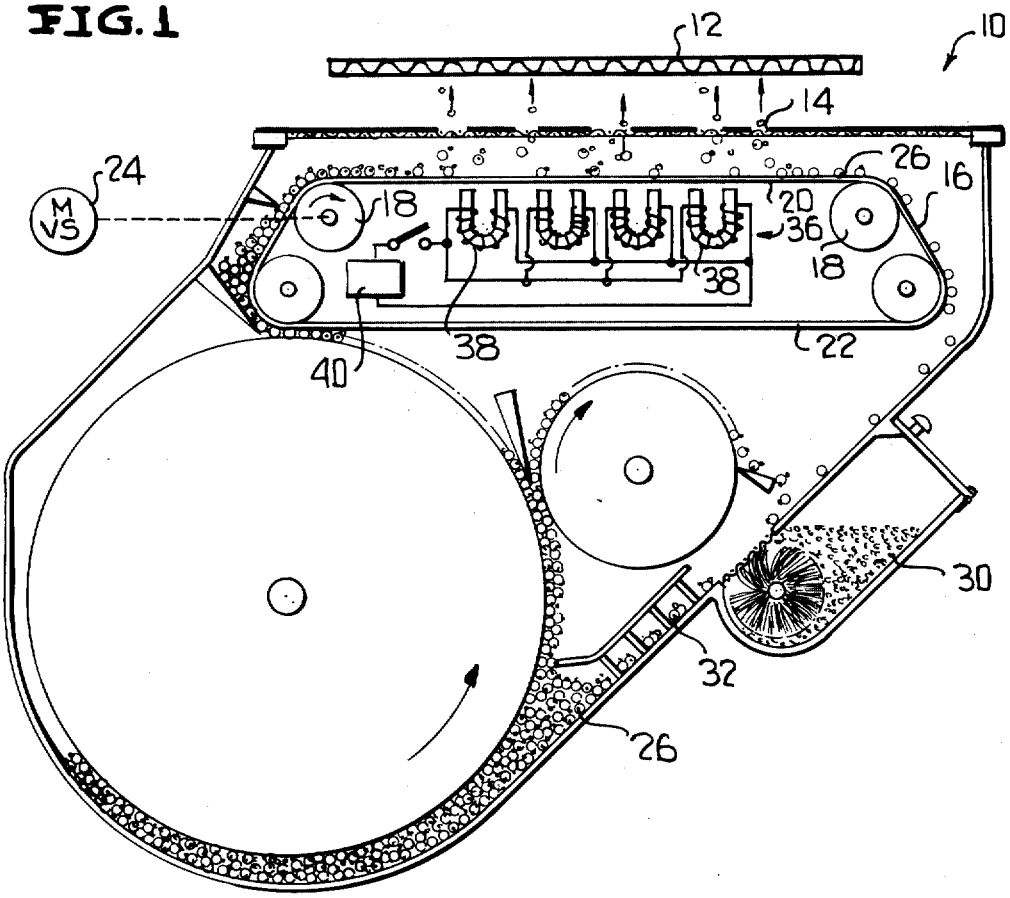
FIG. 1 is a schematic illustration of an electrostatic stencil screen printing machine embodying the present invention.

FIG. 1 shows a diagrammatic elevation of a section through an electrostatic stencil screen printing machine, generally indicated by the numeral 10. The printing and stencil-cleaning characteristics of the printing machine 10 are more particularly described in the aforementioned U.S. Pat. No. 3,306,193 and copending application Ser. No. 768,377, filed on Oct. 17, 1968 and now U.S. Pat. No. 3,610,205. Essentially, a substrate 12 is located in a printing zone above a conductive stencil screen 14 which, in turn, is located in spaced relation above an endless conductive base electrode comprised of a conveyor belt 16. Belt 16 is entrained around a plurality of rollers 18 to divide the belt into an upper portion 20 and a lower portion 22 which are spaced from each other. One of the rollers 18 is suitably connected, for example, to a variable speed motor 24 for causing the belt 16 to carry a wide, long, thin layer of developer 26 beneath the stencil screen 14, and thus the belt 16 constitutes means for locating the developer 26 within a magnetic field created by electromagnets 38 to be described more fully hereinafter. Typically, the layer of developer 26 has a depth on the order of 1/16th of an inch and the top of the layer is spaced approximately ¼th of an inch below the stencil screen 14. Developer 26 is a mixture of ferromagnetic carrier particles and toner comprised of, usually, electrically non-conductive particles. The toner triboelectrically adheres to the surface of the carrier particles and constitutes between 2 to 4% of the developer 26, by weight.

During a typical printing operation, developer 26 vigorously oscillates between stencil screen 14 and belt 16. The carrier particles are too large to pass through stencil screen 14 but toner continues upwardly and is deposited upon substrate 12 in a pattern determined by the openings in the stencil screen. Thus, the layer of developer in the printing zone loses toner from the top layers thereof. While the printing machine 10 is provided with a toner reservoir 30 for replenishing toner to the developer and is also provided with developer mixing means 32, such devices are located outside of the printing zone.

The invention contemplates the use of magnetic stirring appparatus, generally indicated by the numeral 36, located in the space between the upper portion 20 and lower portion 22 of belt 16. Mixing apparatus 36 is comprised of a plurality of electromagnets 38 which are channel-shaped and extend across the width of the printing zone. The magnets 38 are oriented so that their like poles are adjacent to each other.

When the layer of developer 26 is influenced by a magnetic field, vertical filaments of developer are formed so that the layer becomes "brush-like" and filaments of the particles are formed and become aligned in the magnetic field. Tufts of filaments protrude outwardly from the location of the magnets 38 when there is a sufficient field intensity of the magnetic field. If the magnetic field is expanded and collapsed, the tufts are constantly being formed and destroyed. While they exist, they are slid, tumbled, rolled etc., and in general, experience a mixing action. Thus, by providing a sufficient mixing action following a printing operation, a heterogeneous layer of developer 26 can be made homogeneous.

It is clear that relative motion between the layer of developer 26 and a magnet will provide a mixing action. Either the magnet can move, or the developer can move, or they may both move relative to each other. A preferred range of relative velocities exist and have been found to be quite wide, extending above several feet per minute and below several hundred feet per minute. If the relative velocity is too small a vigorous mixing action does not result; if the relative velocity is too high the inertia of the carrier particles apparently does not permit an adequate response. Of course, this velocity range is related to magnetic field intensity and this range was found for intensities of a few hundred gauss.

It has been found that the aforedescribed process is suitable for producing satisfactory mixing but results in an unevenness of the layer of developer 26. Further investigation of the unevenness of the developer layer led to the observation that the layer depth is only disturbed when the magnets are switched "on" and "off." As long as the field is "on" and the belt is carrying the developer through the magnetic field at a uniform velocity, the level of the layer is not permanently disturbed. However, the developer that is located above the the magnets when the magnetic field is switched, forms ridges and troughs in response to variations in field intensity. Ridges are formed in regions where the field intensity is high, such as in the location between the spaced magnets. These ridges are formed of developer drawn out of those regions where the field intensity is low, such as locations above the space separating unlike poles. This leaves troughs in the regions of low field intensity. It has been noted that the disturbance caused by switching the field "on" does not tend to create a problem. If an array of magnets is used, as in the case of a practical printing machine, only one edge of the array produces a lasting disturbance. The disturbances are formed above the entire array, but as these disturbances are carried across the array with the field "on" they are erased by the field except for the edge that is only carried out of the field and not through it. However, this leading edge of the developer can easily just be carried on out of the printing zone where it does no harm, and no more disturbances are formed until the field is switched "off." Disturbances are again formed above the entire array and this time there is no magnetic field to erase them. If the entire printing zone is covered with a magnetic array, then the developer throughout the printing zone will be left in a disturbed condition.

An important feature of the invention is the discovery that the above problem can be solved by gradually reducing the field intensity to zero instead of abruptly turned it "off." This means that, when using electromagnets 38, the current through the windings must decrease gradually to zero instead of being abruptly interrupted. It has been found that the exact time over which this decay of the field should occur is related to the velocity of the belt 16 which carries the layer of developer 26 through the magnetic field. In general, it has been determined that the belt 16 should move perhaps four inches while the field is collapsing. For a belt velocity of 100 feet per minute, this means a collapse time of perhaps 2/10th of a second. When this condition is obtained, the top surface of the layer of developer 26 is not sufficiently disturbed to adversely influence the quality of printing upon substrate 12.

Figure 3:
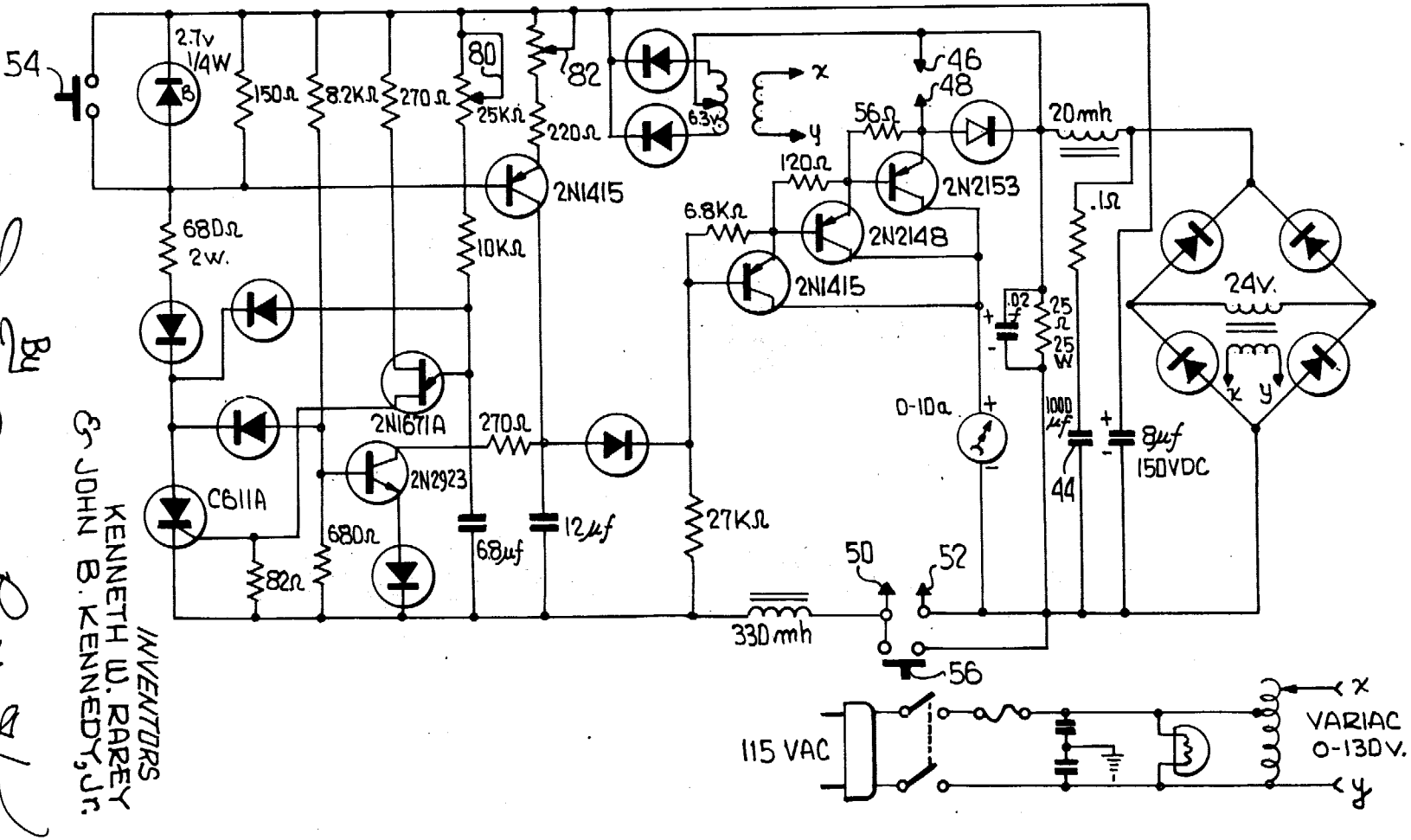
FIG. 3 is a schematic diagram of a power supply for the embodiment of FIG. 1.
Figure 4:
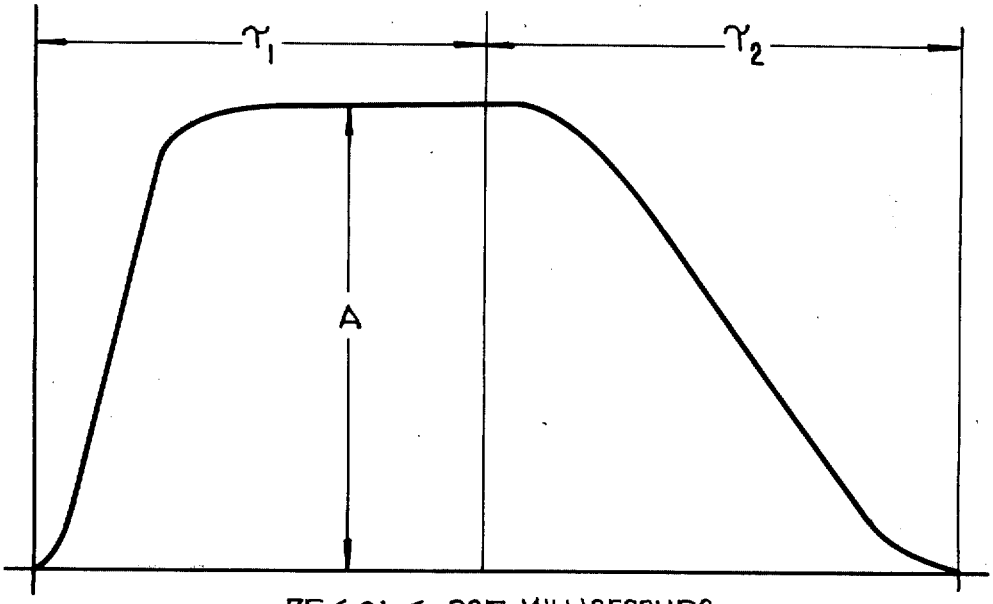
FIG. 4 is a current waveform provided by the power supply shown in FIG. 3.

A power supply 40 makes it possible to select (1) the amplitude of the magnet current, (2) the time the current is "on" at full amplitude, and (3) the time the current will take to collapse to zero. FIG. 3 is a schematic diagram of power supply 40, and FIG. 4 shows the output current waveform.

Essentially, the circuit for power source 40 can be described as an emitter follower amplifier controlled by two independent inputs. The first input drives the amplifier into saturation upon closing of a cam actuated switch (not shown) located on the printing machine 10. The duration of saturation may be adjusted between 75 and 225 milliseconds. The second input is a linear function with time that cancels out the first input. This produces linear decay of magnetic coil current after expiration of the saturation time. The range in linear decay is between 60 and 250 milliseconds. The output current is adjustable and capable of a maximum of 3.8 amperes continuous and 4.5 amperes peak. These ratings are for an effective resistance of 5.3 ohms. This current rating can be increased further by replacing the one thousand microfarad capacitor 44 in the filter circuit with a larger capacitance.

Contacts 46 and 48 are for connecting the power source to the windings of magnets 38. Contacts 50 and 52 are to be connected to the cam actuated microswitch located on the printing machine 10. A coil hold button 54 and a coil manual button 56 are provided so that a coil hold condition can be produced when these buttons are pressed simultaneously.

Figure 5:
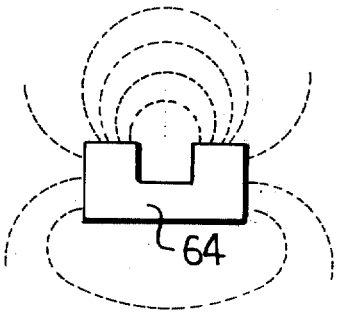
FIG. 5 is an end view qualitatively illustrating a magnetic field associated with a single channel-shaped magnet.
Figure 6:
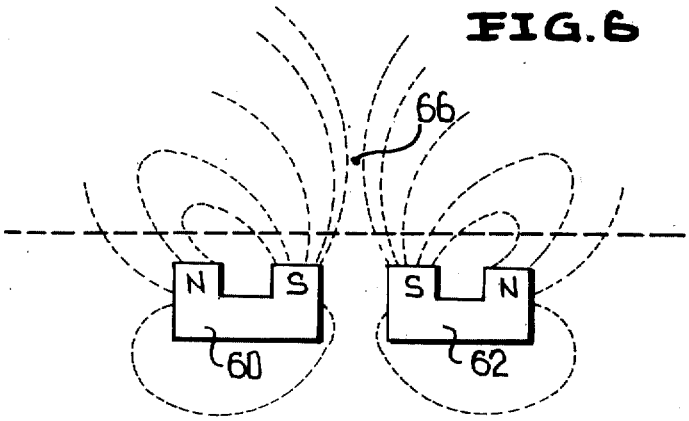
FIG. 6 is an end view of a pair of channel-shaped magnets and qualitatively illustrates the high-intensity magnetic field associated therewith.

As mentioned before, it is important that the magnets 38 have like notes adjacent to each other. This aids in acquiring an adequate field intensity without using excessive currents. As is shown in FIG. 6, two channel magnets 60 and 62 are arranged with their like poles facing each other. While the poles are shown as being south-to-south, the poles may also be north-to-north. A single channel magnet 64 is shown in FIG. 5. FIGS. 5 and 6 illustrate qualitatively the end view of the magnetic fields associated with the respective magnets. A comparison of these two fields shows how the fields of the oriented magnets 60 and 62 provide an improved mixing field as compared to the field shown in FIG. 5. It should be particularly noted that a high intensity vertical field is indicated in the region of point 66 in FIG. 6.

Figure 2:
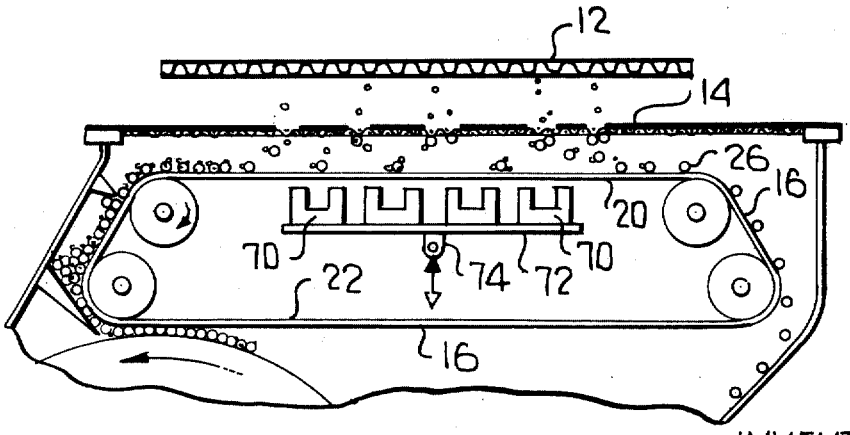
FIG. 2 is a fragmentary illustration of a modified form of the invention.

Illustrated in FIG. 2 is another manner of varying the magnetic field which acts upon the layer of developer 26 in the printing zone. A plurality of channel-shaped permanent magnets 70 are disposed in side-by-side relationship beneath the upper portion 20 of belt 16. Here again, the magnets 70 are oriented so that like poles are adjacent to each other in the manner illustrated in FIG. 6. The magnets 70 extend across the width of the printing zone and are supported by a suitable supporting member 72. Various types of mechanisms may be attached to the supporting member 72 by a mechanical connection 74. A suitable drive means (not shown) can be used to move the magnets 70 toward and away from the upper portion 20 of belt 16 thereby providing a means for increasing or decreasing the field intensity acting upon the layer of developer 26. By controlling the rate of withdrawal of the magnets 70 away from the upper portion 20, it is possible to reduce the field intensity in such a manner as to leave the layer of developer 26 in an undisturbed, or smooth, layer. One suitable drive means which can be connected to the member 72 would be a mechanical connection which includes a particularly designed cam and cam follower for controlling the rates of approach and withdrawal of the magnets 70; another way of providing the same movement would be to use a fluid motor and control opening and closing of suitable valves to control fluid flow. In either event, means are provided for effecting relative movement between the magnet 70 on support means 72 and the developer on the upper portion of belt 16 and, therefore, it is possible to properly control the field intensity acting upon the layer of developer 26.

Referring again to the schematic diagram of FIG. 3, it is to be understood that this power supply is particularly useful as an investigative tool. Of course, various changes may be made in such circuitry so that a simplified version would be useful on a standardized printing machine. The various resistors, diodes, capacitors, and other semi-conductive elements are labelled on the drawings. All diodes are of the type identified by 1N1692, unless specified otherwise. The rheostat 80 may be adjusted to vary the "on" time, while the rheostat 82 may be adjusted to vary the "decay" time.

While preferred forms and arrangement of parts have been shown in illustrating the invention, it is to be understood that various changes in details and arrangement of parts may be made without departing from the spirit and scope of the invention, as defined in the appended claimed subject matter.

We claim:

1. Apparatus for stirring a developer comprised of magnetic particles and non-magnetic particles, said apparatus comprising means for creating a magnetic field, means for locating said developer within said magnetic field, and means for variably controlling the field intensity of said magnetic field.

2. Apparatus as defined in claim 1 wherein said means for creating a magnetic field comprises a plurality of magnets disposed adjacent to each other, said magnets being oriented with like poles facing each other.

3. Apparatus as defined in claim 2 wherein said magnets are permanent magnets.

4. Apparatus as defined in claim 3 wherein said means for locating said developer within said magnetic field comprises movable support means for effecting relative movement between said magnets and said developer, said means for controlling the field intensity of said magnetic field comprising means for varying the rate of withdrawal of said magnets away from said developer.

5. Apparatus as in claim 1 wherein said means for creating a magnetic field comprise electromagnetic means.

6. Apparatus as defined in claim 1 in combination with an electrostatic printing machine including a stencil screen, said means for locating said developer within said magnetic field comprising a base member located in spaced relation to and below said stencil screen for supporting said developer beneath said stencil screen.

7. Apparatus as defined in claim 6 wherein said base member comprises an endless conveyor belt entrained around spaced roller means for providing said belt with spaced upper and lower portions and said means for creating a magnetic field being disposed within the space between said upper and lower portions.

8. Apparatus as defined in claim 7 including variable speed drive means connected to said roller means for rotating said belt around said means for creating a magnetic field.

9. Apparatus for stirring a developer comprised of magnetic particles and non-magnetic particles, said apparatus comprising means for creating a magnetic field, means for locating said developer within said magnetic field, and means for variably controlling the field intensity of said magnetic field; wherein said means for creating a magnetic field includes magnet means and windings for providing electromagnetic means, and said means for controlling the field intensity of said magnetic field comprises means for causing electric current to flow in said windings, means for gradually reducing said current to zero, and means for controlling the time needed to reduce said current to zero.

10. Apparatus as in claim 9 including means for controlling the amplitude of said electric current.

11. Apparatus as in claim 10 including means for controlling the time during which said current is at peak amplitude.

* * * * *